United States Patent [19]

Wang

[11] Patent Number: 5,016,414

[45] Date of Patent: May 21, 1991

[54] IMITATED CARVED WOODEN DOOR HAVING THREE-DIMENSIONAL PANEL STRUCTURE

[76] Inventor: Guo-Chi Wang, P.O. Box 55-1670, Taipei, Taiwan

[21] Appl. No.: 553,575

[22] Filed: Jul. 8, 1990

[51] Int. Cl.[5] ..... E06B 3/78; E04C 2/36

[52] U.S. Cl. ..... 52/456; 52/455; 52/309.11; 52/309.16

[58] Field of Search ..... 52/455, 456, 309.7, 52/309.8, 309.11, 309.16

[56] References Cited

U.S. PATENT DOCUMENTS

| | | | |
|---|---|---|---|
| 3,546,841 | 2/1966 | Smith et al. | 52/309.11 |
| 3,731,449 | 5/1973 | Kephart | 52/309.7 |
| 3,950,894 | 4/1976 | Di Maio | 52/309.7 |
| 4,072,548 | 2/1978 | Gerson et al. | 52/309.9 |
| 4,147,004 | 4/1979 | Day et al. | 52/309.9 |
| 4,265,067 | 5/1981 | Palmer | 52/455 |
| 4,284,447 | 8/1981 | Dickens et al. | 52/309.7 |
| 4,550,540 | 11/1985 | Thorn | 52/456 |
| 4,901,493 | 2/1990 | Thorn | 52/455 |

*Primary Examiner*—Richard E. Chilcot, Jr.
*Assistant Examiner*—Robert J. Canfield

[57] ABSTRACT

An imitated carved wooden door includes: a plastic leather imitating a wooden surface having three-dimensional recess and extending portions formed therein by an integral molding process, a lining core body reinforced in the surface plastic leather retained in a supporting framework, wherein the lining core body may be pre-formed by a molding process having three-dimensional recess and extending portions engageable with the recess and extending portions of the surface plastic leather so as to form an imitated carved wooden door having a more vivid three dimensional structure approaching a real carved wooden door.

5 Claims, 4 Drawing Sheets

IMITATED CARVED WOODEN DOOR HAVING THREE-DIMENSIONAL PANEL STRUCTURE

BACKGROUND OF THE INVENTION

A conventional carved wooden door if made with real solid wood material may increase an installation cost when constructing an economic apartment or building. Recently developed imitated carved wooden door as shown in FIG. 7 trying to reduce the door cost includes a plastic leather L integrally formed with upwardly extending decorative features E for imitating a true carved wooden surface, which plastic leather is adhered with a plywood substrate plate for supporting and backing the surface plastic leather. However, such a molded plastic leather can only be made to extend those imitated decorative carved features upwardly from the leather sheet and can not be recessed downwardly under the leather layer as backed by a rigid plywood substrate plate, to therefore be lacking of vivid esthetic decorative effect. When depressing or contacting those extended features E having void interior between the plastic leather and its backing substrate plate, the hollow extended features E may be collasped, broken or deformed to damage the door and the interior decoration.

The present inventor has found the drawbacks of a conventional imitated carved wooden door and invented the present imitated wooden door having three-dimensional panel structure.

SUMMARY OF THE INVENTION

The object of the present invention is to provide an imitated carved wooden door including a plastic leather imitting a wooden surface having three-dimensional recess and extending portions formed therein by integrally molding process, a lining core body reinforced in the surface plastic leather retained in a supporting framework, wherein the lining core body may be preformed by molding precess having three-dimensional recess and extending portions engageable with the recess and extending portions of the surface plastic leather so as to form an imitated carved wooden door having more vivid dimensional structure approaching a real carved wooden door.

DETAILED DESCRIPTION

Figure 1:
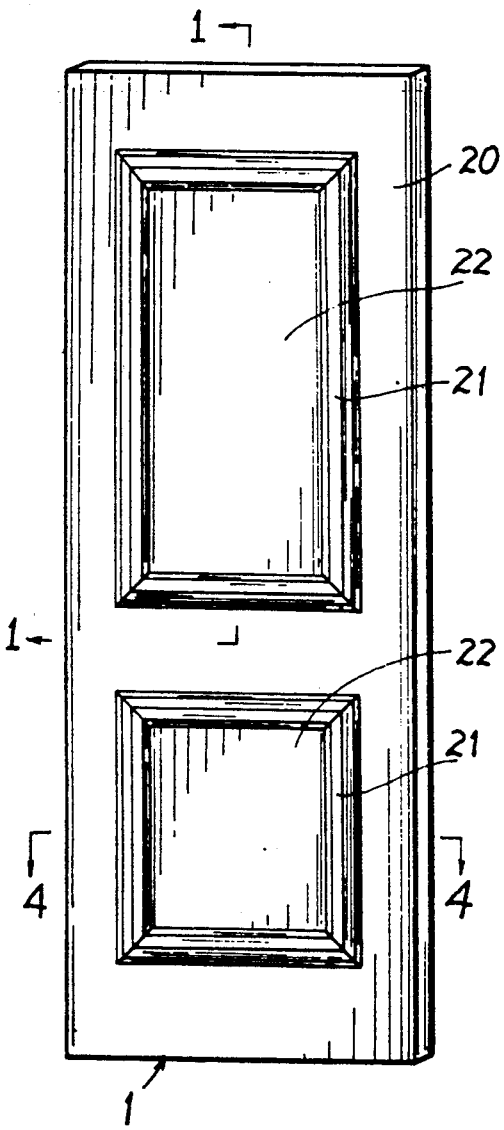
FIG. 1 is a perspective view of the present invention.
Figure 1A:
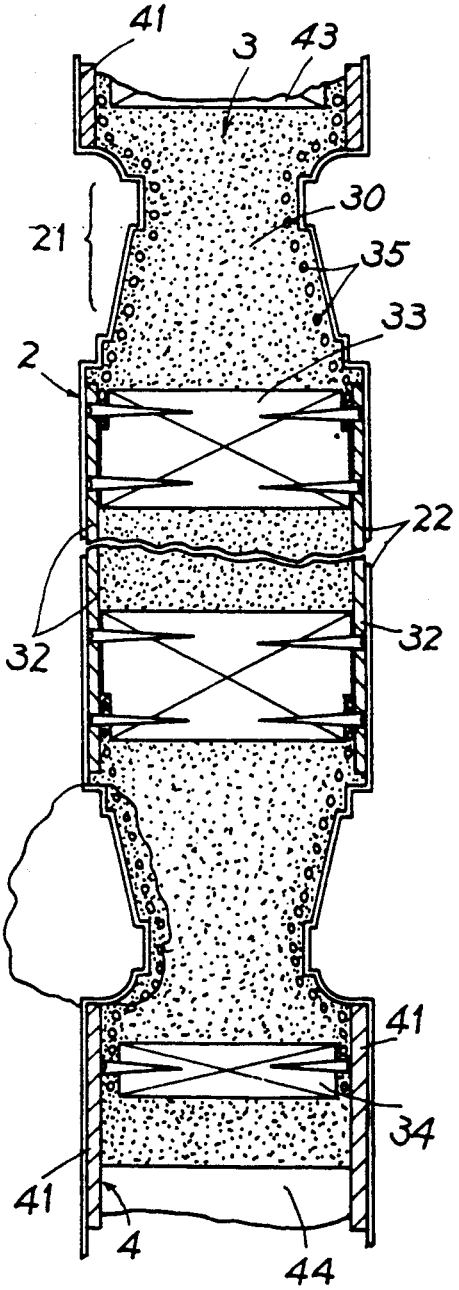
FIG. 1*a* is a partial sectional drawing of the present invention when viewed from 1—1 direction of FIG. 1.
Figure 5:
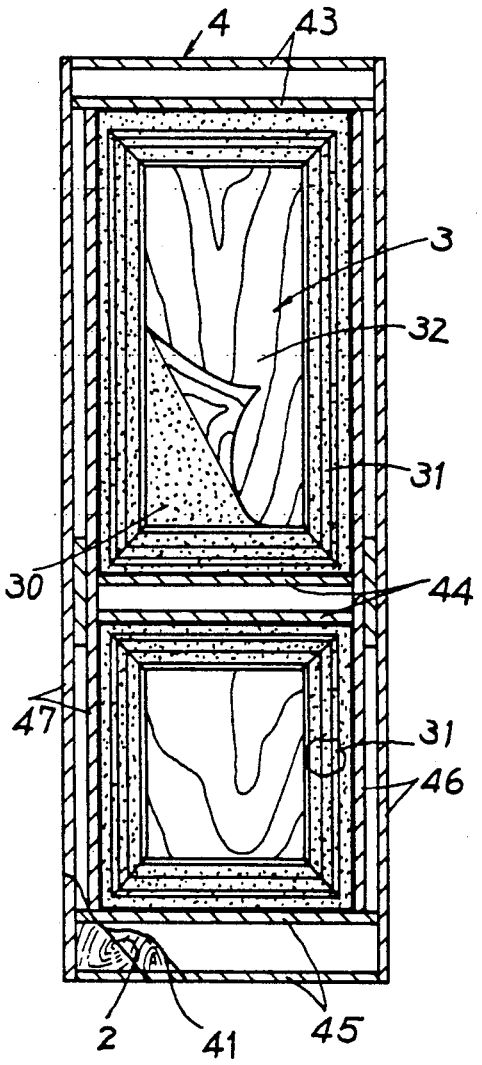
FIG. 5 is an illustration of the present invention when removing the surface plastic leather.
Figure 6:
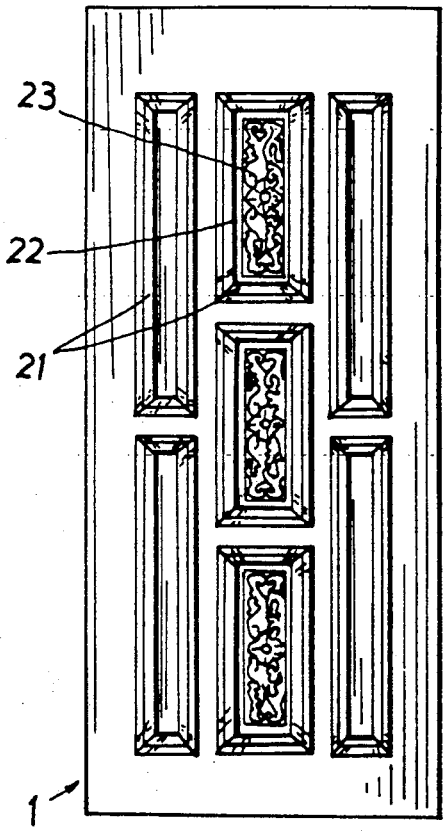
FIG. 6 shows another preferred embodiment of the present invention.
Figure 7:
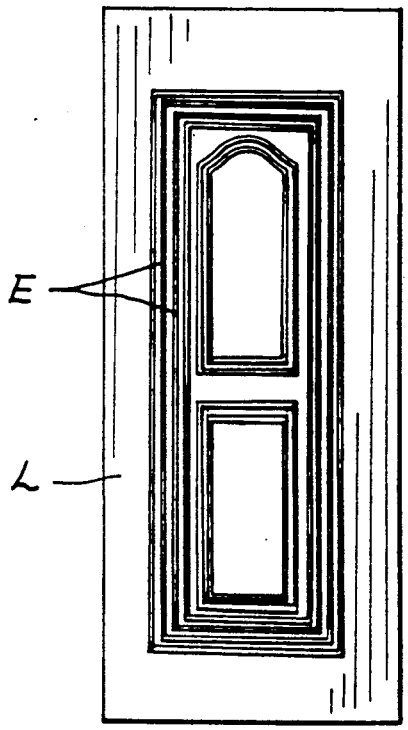
FIG. 7 PRIOR ART
FIG. 7 shows a prior art of conventional imitated carved wooden door.

As shown in FIG. 1-5, the present invention comprises a pair of surface plastic leathers 2 imitating a wooden surface, at least a lining core body 3, and a supporting framework 4 forming an imitated carved wooden door 1 as shown in FIG. 1 and FIG. 6 which is added with flower decoration integrally molded and recessed in the plastic leather 2. The core body 3 and the supporting framework 4 are sandwiched between the pair of plastic leathers 2.

Each plastic leather 2 is selected from a rigid plastic sheet which may be integrally formed by thermoforming process to imitate a wooden material having wooden texture and surface. The plastic leather 2 is formed with at least a recess portion 21 which may be a rectangular groove having irregular slope and depth of a cross section of the groove and at least an extending portion 22, and formed with a side fencing portion 20 confining the recess portion 21 and the extending portion 22.

The lining core body 3 is integrally formed by plastic molding or foaming process and includes: a filler core 30 having at least a recess lining protion 31 recessed in the core 30, two extending panels 32 disposed on front and rear sides of the core 30, a plurality of reinforcing plates 33 transversely juxtapositionally formed in the core 30 each reinforcing plate 33 secured between the two panels 32 by fixing nails 321, an upper and lower reinforcing plate 34 formed in an upper and a lower portion of the core 30, and a plurality sets of wire mesh 35 reinforced on a surface of a front side and a rear side of the core 30.

Figure 1B:
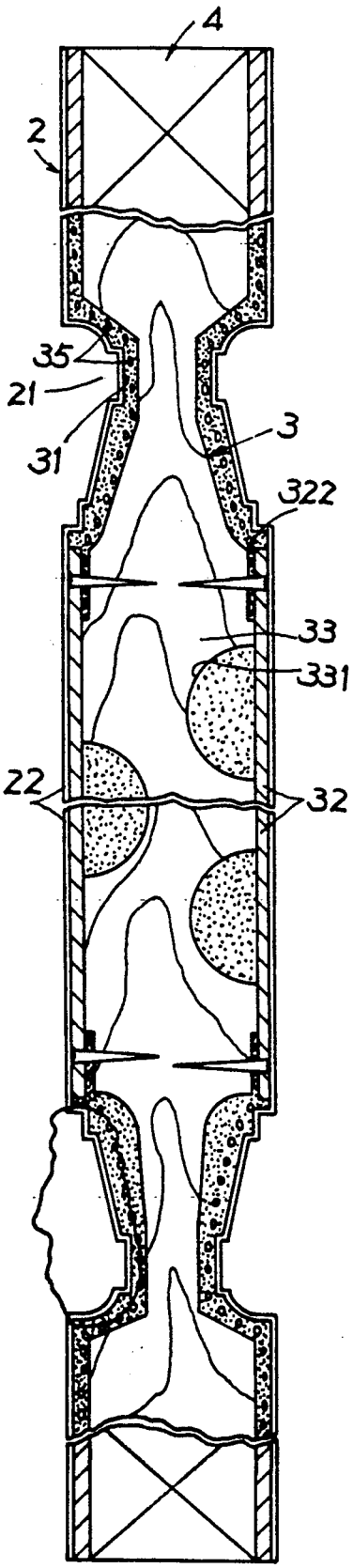
FIG. 1*b* is a sectional drawing of the present invention viewed from 4—4 direction of FIG. 1.
Figure 3:
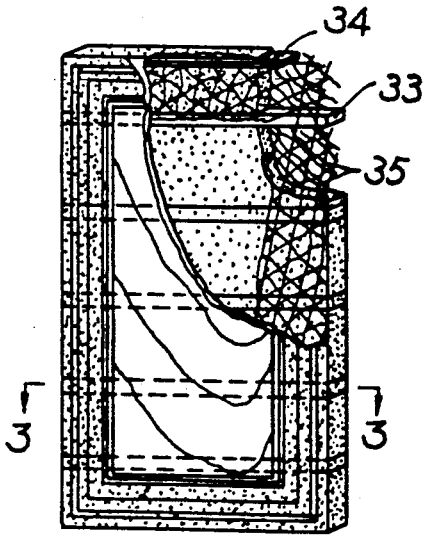
FIG. 3 is an illustration showing a cut-away lining core body of the present invention.
Figure 3A:
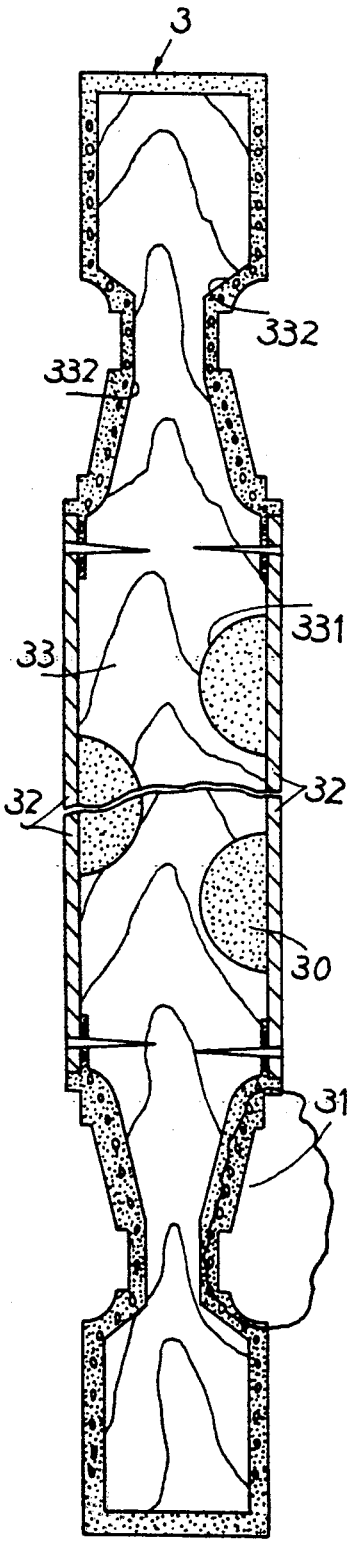
FIG. 3*a* is a sectional drawing of the present invention when viewed from 3—3 direction of FIG. 3.
Figure 4:
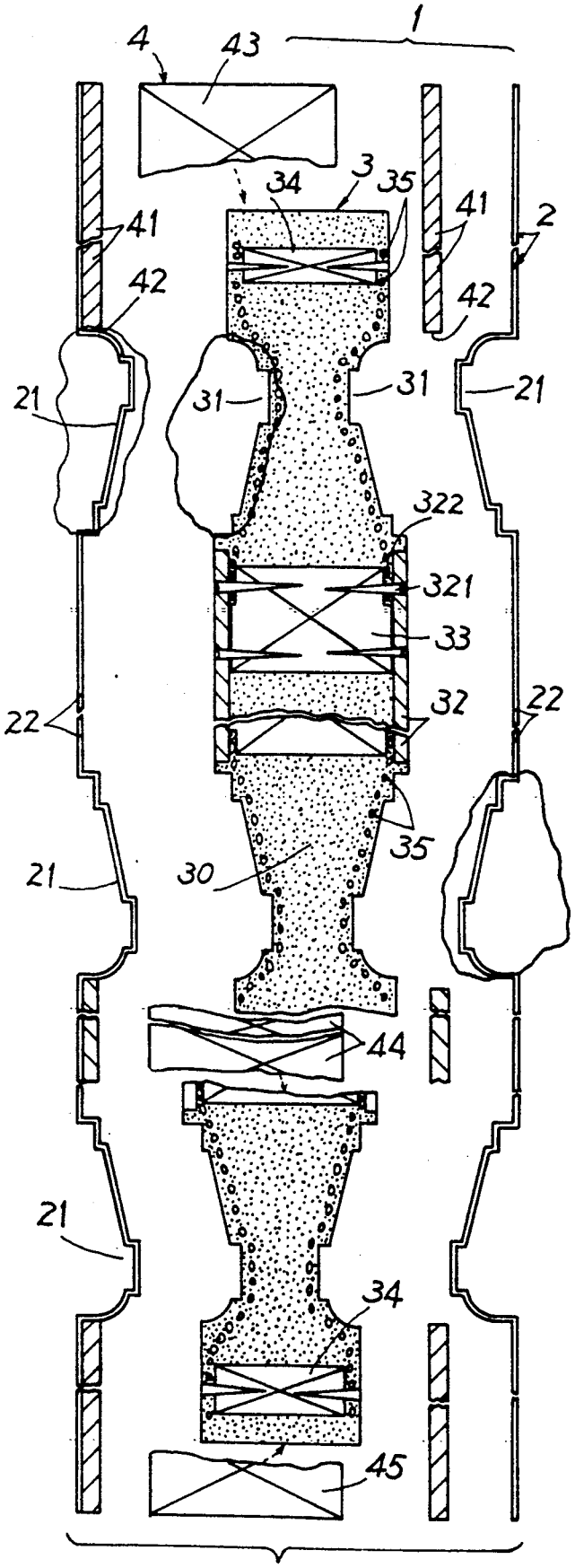
FIG. 4 is an exploded view showing the elements in construction of the present invention.

The core 30 may be selected from plastic materials of polyurethane, copolymer of acrylonitrile-butadiene-styrene, foamed polystyrene and may be molded or foamed in a mold. In order to match the foaming or molding produce with a mold for making the lining core body 3, the plural reinforcing plate 33 may be cut or preformed with recess portions 332 corresponding to the recess portions 31, 21 as shown in FIGS. 1*b*, 3*a*. Each reinforcing plate 33 is formed with a plurality of through holes 331 for flowing plastic resin or foam material during foaming or molding process. Each wire mesh 35 may be inserted into an aperture 322 between the reinforcing plate 33 and the extending panel 32. A fire retarding composition or agent may be added into the core 30 during its molding or foaming process. The reinforcing plates 33, 34 may be selected from wood, metal, or artifical wood added with fire retarding composition.

Figure 2:
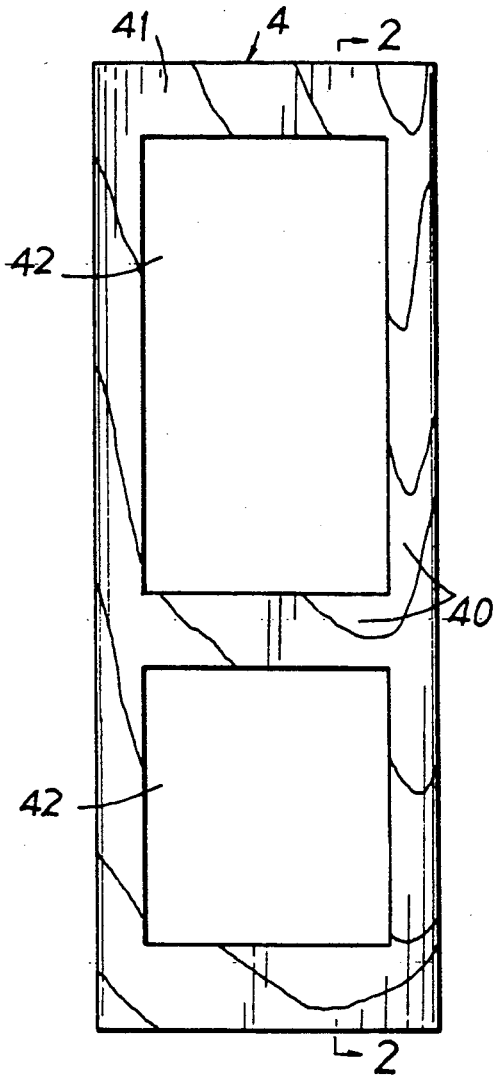
FIG. 2 is a front view of a frame board of the supporting framework of the present invention.

The supporting framework 4 includes: a pair of frame boards 41 as shown in FIG. 2 and 5 disposed on a front and rear side of the door 1 each formed with at least an opening 42 for inserting each said lining core body 3 in the opening 42 and having a side frame portion 40 confining the opening 42 therein, an upper horizontal beam 43 formed in an upper portion of the door 1 spaced between the two boards 41, a middle horizontal beam 44 formed in a middle portion of the door 1 spaced between the two boards 41, a lower horizontal beam 45 formed in a lower portion of the door 1 spaced between two boards 41, a first vertical column 46 formed on a right side of the door 1, and a second vertical column 47 formed on a left side of the door. The frame board 41 is selected from wooden plate, plywood or artificial wooden plate added with fire retarding agent and is adhered under the plastic leather 2 except the recess portion 21. The beams 43, 44, 45 and columns 46, 47 may be made of wooden material, or artificial wood added with fire retarding agent.

After securing the lining core bodies 3 into the opening 42 of the framework 4, the surface plastic leather 2 are secured or bonded on both front and rear sides of the framework 4 and core bodies 3 by adhesive, or by other fixing methods wellknown in the art. The shape of recess portion 21, 31 of the present invention is not limited, which may be formed as rectangular grooves, curves or many other irregular features.

The present invention is superior to a conventional imitated carved wooden door with the following advantages:

1. The lining core body 3 and surface plastic leather 2 can be performed with recess portions and extending portions of different shapes, three-dimensional structures for imitating a carved wooden door more vividly and esthetically.

2. The recess portion 21 of surface leather 2 is backed and engageable with a recess portion 31 of the lining body so as to form a solid touch feeling and to prevent collapse of deformation upon a depression by an external force.

3. A complex decorative featuare can be formed by this application to increase the commerical value of an imitated wooden door as approximately true as a real carved wooden door.

The extending portion 22 of the plastic leather 2 and the extending panel 32 of the lining core body 3 of this invention may be further formed with three-dimensinal decorative features 23 by integral molding process on the leather 2 and the core body 3 for further decorative purpose such as shown in FIG. 6.

I claim:

1. An imitated carved wooden door comprising:

a pair of surface plastic leathers imitating a true wooden material having wooden texture and surfaces disposed on a front side and a rear side of an imitated carved wooden door, having at least a recess portion and an extending portion formed therein after;

at least a lining core body each said core body secured between said pair of surface plastic leathers and each said core body integrally made to have a plurality of recess portions engageable with and backed under the recess portions formed in said surface plastic leathers and a plurality of extending panels engageable with and backed under the extending portions of said plastic leathers; and a supporting framework securing said lining core body thereon having said pair of surface plastic leathers disposed on a front side and a rear side of said supporting framework for forming an imitated carved wooden door having said lining core body and said supporting framework sandwiched between said pair of surface plastic leathers;

said lining core body including a filler core integrally formed by a foaming or molding process, a plurality of reinforcing plates transversely formed in the filler core disposed between said pair of extending panels, and a plurality of wire meshes reinforced under a surface of the filler core, each said reinforcing plate and each said extending panel of the lining core body defining an aperture therebetween for inserting each said wire mesh in said aperture; and said filler core being selected from plastic materials or foam material preformed with at least a recess portion therein and an extending portion thereon.

2. An imitated carved wooden door according to claim 1, wherein said filler core is made of plastic materials selected from polyurethane, polystyrene, and copolymer acrylonitrile-butadienue-styrene.

3. An imitated carved wooden door according to claim 1, wherein said reinforcing plates are made of materials selected from: wood, metal, or artificial wood added with fire retarding agent.

4. An imitated carved wooden door according to claim 1, wherein said supporting framework includes a pair of frame boards each board formed with at least an opening therein for mounting each said lining core body in said opening, to be disposed on both front side and rear side of the carved wooden door, an upper horizontal beam formed on an upper portion of the door, a middle horizontal beam formed on a middle portion of the door, a lower horizontal beam formed on a lower portion of the door, and two vertical columns disposed on a right side and a left side of the door, all said beams and columns being spaced between said two frame boards for mounting said lining core body therein; said pair of plastic leathers covering said supporting framework and said lining core body.

5. An imitated carved wooden door according to claim 4, wherein said supporting framework is made of wood, plywood or artificial wood added with fire retarding agent.

* * * * *